US008866053B2

(12) United States Patent
Berdut-Teruel

(10) Patent No.: US 8,866,053 B2
(45) **Date of Patent: *Oct. 21, 2014**

(54) PERMANENT MAGNET INDUCTION HEATING SYSTEM

(76) Inventor: Elberto Berdut-Teruel, San Juan, PR (US)

( * ) Notice: Subject to any disclaimer, the term of this patent is extended or adjusted under 35 U.S.C. 154(b) by 157 days.

This patent is subject to a terminal disclaimer.

(21) Appl. No.: 12/878,117

(22) Filed: Sep. 9, 2010

(65) Prior Publication Data

US 2011/0272399 A1 Nov. 10, 2011

Related U.S. Application Data

(63) Continuation-in-part of application No. 12/775,880, filed on May 7, 2010.

(51) Int. Cl.
*H05B 6/36* (2006.01)
*H05B 6/10* (2006.01)

(52) U.S. Cl.
CPC ..... *H05B 6/109* (2013.01); *H05B 6/108* (2013.01)
USPC ..... 219/672; 219/10.51; 219/10.65; 219/601; 219/627; 219/677

(58) Field of Classification Search
CPC ..... H05B 6/108; H05B 6/109
USPC ..... 219/10.51, 10.65, 10.491, 601–602, 219/607, 627–632, 635, 643–644, 658, 219/670–672, 677, 648–649, 652
See application file for complete search history.

(56) References Cited

U.S. PATENT DOCUMENTS

| | | | | | |
|---|---|---|---|---|---|
| 2,008,617 | A | | 8/1937 | Sola | |
| 2,178,720 | A | | 11/1939 | Daniels | |
| 2,448,009 | A | | 8/1948 | Baker | |
| 2,549,362 | A | | 4/1951 | Bessiere et al. | |
| 2,912,552 | A | * | 11/1959 | Baermann | 219/622 |
| 3,017,545 | A | * | 1/1962 | Meier | 335/295 |
| 3,290,476 | A | * | 12/1966 | Scheffler | 219/649 |
| 3,377,417 | A | * | 4/1968 | Capita | 373/138 |
| 3,412,229 | A | * | 11/1968 | Seagrave, Jr. | 219/619 |
| 3,899,885 | A | * | 8/1975 | Hagerty | 60/203.1 |
| 3,928,744 | A | * | 12/1975 | Hibino et al. | 219/624 |
| 4,145,591 | A | * | 3/1979 | Takeda | 219/618 |
| 4,174,994 | A | * | 11/1979 | Savelkouls | 156/389 |
| 4,421,967 | A | | 12/1983 | Birgel et al. | |
| 4,649,249 | A | * | 3/1987 | Odor | 219/659 |
| 4,761,527 | A | | 8/1988 | Mohr | |
| 5,012,060 | A | * | 4/1991 | Gerard et al. | 219/631 |
| 5,227,596 | A | * | 7/1993 | McGaffigan et al. | 219/616 |
| 5,274,207 | A | * | 12/1993 | Griffith | 219/618 |
| 5,443,132 | A | * | 8/1995 | Arnold | 188/138 |
| 5,455,402 | A | * | 10/1995 | Griffith | 219/630 |
| 5,487,875 | A | * | 1/1996 | Suzuki | 422/186.05 |
| 5,523,732 | A | * | 6/1996 | Leupold | 335/306 |
| 5,526,103 | A | | 6/1996 | Kato et al. | |

(Continued)

*Primary Examiner* — Dana Ross
*Assistant Examiner* — Ket D Dang
(74) *Attorney, Agent, or Firm* — Luis Figarella

(57) ABSTRACT

A permanent magnet thermal generator having a rotating chamber with an attached optionally rotational heat element in close proximity to one or more permanent magnets. The relative motion of the heat element to the magnetic flux from the magnets results in heat generation and in some cases in levitation. Clothe driers, air furnaces, water heaters and other systems incorporating a permanent magnet thermal generator are also set forth.

12 Claims, 7 Drawing Sheets

(56) References Cited

U.S. PATENT DOCUMENTS

| | | | | |
|---|---|---|---|---|
| 5,660,744 | A * | 8/1997 | Sekine et al. | 219/121.43 |
| 6,011,245 | A * | 1/2000 | Bell | 219/631 |
| 6,092,531 | A * | 7/2000 | Chen et al. | 128/899 |
| 6,455,824 | B2 | 9/2002 | Takagi et al. | |
| 6,681,998 | B2 * | 1/2004 | Sharpe et al. | 239/13 |
| 6,782,802 | B2 * | 8/2004 | Hunot et al. | 99/341 |
| 6,909,861 | B2 | 6/2005 | Asayama | |
| 6,984,897 | B2 | 1/2006 | Skeist et al. | |
| 7,071,694 | B1 * | 7/2006 | Kruip | 324/323 |
| 2008/0061054 | A1 * | 3/2008 | Shirakata et al. | 219/619 |
| 2008/0110873 | A1 * | 5/2008 | Ho | 219/396 |
| 2008/0240805 | A1 | 10/2008 | Kinouchi et al. | |
| 2009/0051235 | A1 * | 2/2009 | Brown | 310/74 |
| 2010/0170885 | A1 * | 7/2010 | Cretors | 219/469 |

* cited by examiner

PERMANENT MAGNET INDUCTION HEATING SYSTEM

CROSS-REFERENCE TO RELATED APPLICATIONS

This application is a continuation-in-part of pending U.S. application "Permanent Magnet Induction Heating", Ser. No. 12/775,880 the disclosure of which is incorporated herein by reference in its entirety.

PATENTS CITED

The following documents and references are incorporated by reference in their entirety, Skeist et al (U.S. Pat. No. 6,984,897), Gerard et al (U.S. Pat. No. 5,012,060) and Mohr (U.S. Pat. No. 4,671,527).

TECHNICAL FIELD

The present invention generally relates to inducing heat and levitation onto surfaces with metallic components from permanent magnets in various configurations.

BACKGROUND

Many processes today use fossil fuels (either directly or through the use of electricity generated using said fossil fuels). For example, clothe driers, water heaters, space heaters and other applications such as these are routinely performed using thermic heat generated either via electric radiance, or through the burning of gases such as Propane.

The induction of heat via electric current created electromagnetic fields is well understood and has been selected by many designers in order to tightly control the application of the heat (via the intensity of the magnetic field). However, in many cases, permanent magnet thermal generators are not used. This results in the burning of additional resources in order to generate the heat for the process.

A number of permanent magnet thermal generators have been suggested in the past. Skeist et al (U.S. Pat. No. 6,984,897), Gerard et al (U.S. Pat. No. 5,012,060) and Mohr (U.S. Pat. No. 4,671,527), among others, suggest the use of permanent magnets and a heat transfer fluid.

Most of these produce the heat, but often at the cost of additional complexity. In most cases, these permanent magnet thermal generators have the undesired effects of putting rotating stresses on the magnets and dispersing the thermal energy among others.

What is required is a heating and levitation system using permanent magnets that overcomes the many complications and limitations of the previous systems.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

Prior art permanent magnet heat induction machines suffer from significant complexity, utilizing rotating mechanisms of exceeding complication, the present invention significantly reduces the complexity of the previous arrangements. In one aspect, a permanent magnet thermal generator apparatus has one or more fixed surfaces, with one or more permanent magnets with a North polarity attached to at least one said fixed surface and one or more permanent magnets with a South polarity attached to at least one said fixed surfaces, one or more heating elements comprised of at least one metallic portion whose surface is placed on a significantly parallel plane to at least one of said fixed surfaces and a rotating chamber which is mechanically linked to said heating element so that rotation of the chamber causes motion of the heating element past the permanent magnet's magnetic fields.

In one aspect the relative motion of the rotating chamber causes a relative rotating motion between the fixed surfaces and the heating element surface. In one embodiment, the heating element is comprised of significantly ferrous metals, in another the heating element is comprised of significantly non-ferrous metals. In yet another embodiment, the heating element is comprised of a combination of ferrous and non-ferrous metals. In another embodiment the heating element is comprised of a combination of metallic and non-metallic materials.

In one aspect, the relative motion of the rotating chamber causes a relative linear motion between the fixed surfaces and the heating element surfaces. In one embodiment, the heating element is comprised of significantly ferrous metals, in another the heating element is comprised of significantly non-ferrous metals. In yet another embodiment, the heating element is comprised of a combination of ferrous and non-ferrous metals. In another embodiment the heating element is comprised of a combination of metallic and non-metallic materials.

In another aspect of the present invention a permanent magnet thermal generator apparatus is shaped as a cylinder comprising one or more permanent magnets with a North polarity, and one or more permanent magnets with a South polarity with one or more heating elements having at least one metal portion adjacent to said cylinder and a mechanism for rotating the cylinder so that its rotation causes its magnetic flux to induce a temperature increase in the adjacent heating elements.

In one embodiment, the heating elements are comprised of hollow tubes comprised significantly of ferrous metals. In another embodiment, the heating elements are comprised of hollow tubes comprised significantly of non-ferrous metals. In yet another embodiment, the heating elements are comprised of hollow tubes comprised of a combination of ferrous and non-ferrous metals. In another embodiment, the heating elements are comprised of hollow tubes comprised of a combination of metallic and non-metallic materials. In one embodiment, the heating elements are comprised of solid metal rods contained within non-metallic tubes.

In another aspect, the present invention comprises a permanent magnet thermal generator apparatus comprising a first cylinder having one or more permanent magnets with a North polarity, and one or more permanent magnets with a South polarity around its periphery, and one or more second cylinders with at least one metal portion adjacent to said cylinder, plus a mechanism for rotating both the first cylinder and the second cylinder so that their rotation causes the magnetic flux from the first cylinder to induce a temperature increase in the adjacent second cylinder(s).

In another aspect a permanent magnet heating generator apparatus comprises a permanent magnet surface, said surface comprising one or more permanent magnets with a North polarity, and one or more permanent magnets with a South polarity, and one or more heating surfaces with metallic portions adjacent and parallel to said surface and mechanical means for rotating said surface. In one embodiment, the heating surfaces are comprised of significantly non-ferrous metals. In another the levitation surfaces are comprised of a combination of metallic and non-metallic materials.

In another aspect, a permanent magnet levitation generator apparatus comprising one or more first surfaces, each of said first surfaces having one or more permanent magnets with a North polarity, and one or more permanent magnets with a South polarity. One or more second surfaces, each of said second surfaces having one or more metallic portions adjacent and significantly parallel to one or more of said first surfaces, and mechanical means for moving at least one first surface relative to at least one second surface.

In one aspect, the mechanical means rotate at least one said first surface relative to at least one second surface, and the metallic portions of at least one said second surface are comprised significantly of non-ferrous metals. In an alternate embodiment, the mechanical means displace linearly at least one said first surface relative to at least one said second surface, and the metallic portions of at least one second surface are comprised significantly of non-ferrous metals. In one aspect, the levitation surfaces are comprised of significantly non-ferrous metals. In another the levitation surfaces are comprised of a combination of metallic and non-metallic materials.

In another aspect, a permanent magnet thermal generator apparatus comprises a first cylinder having one or more permanent magnets with a North polarity, and one or more permanent magnets with a South polarity, one or more orbital cylinders assemblies are within it magnetic field, each orbital cylinder having at least one metal portion adjacent to said cylinder; and a mechanism for rotating both the first cylinder and one or more of the orbital cylinders so that their rotation causes the magnetic flux from the first cylinder to induce a temperature increase in one or more of the adjacent orbital cylinders.

In another aspect the orbital cylinders are comprised of hollow tubes comprised significantly of ferrous metals surrounding non-ferrous materials. In another aspect, the orbital cylinders are comprised of hollow tubes comprised significantly of non-ferrous metals. In one aspect, the orbital cylinders are comprised of hollow tubes comprised of a combination of ferrous and non-ferrous metals. In another aspect, the orbital cylinders are comprised of hollow tubes comprised of a combination of metallic and non-metallic materials. In yet another aspect, the orbital cylinders are comprised of solid metal rods contained within non-metallic tubes.

Other features and advantages of the present invention will become apparent upon examining the following detailed description of an embodiment thereof, taken in conjunction with the attached drawings.

DETAILED DESCRIPTION

To provide an overall understanding of the invention, certain illustrative embodiments will now be described, including apparatus and methods. However, it will be understood by one of ordinary skill in the art that the systems and methods described herein may be adapted and modified as is appropriate for the application being addressed and that the systems and methods described herein may be employed in other suitable applications, and that such other additions and modifications will not depart from the scope hereof.

Figure 1:
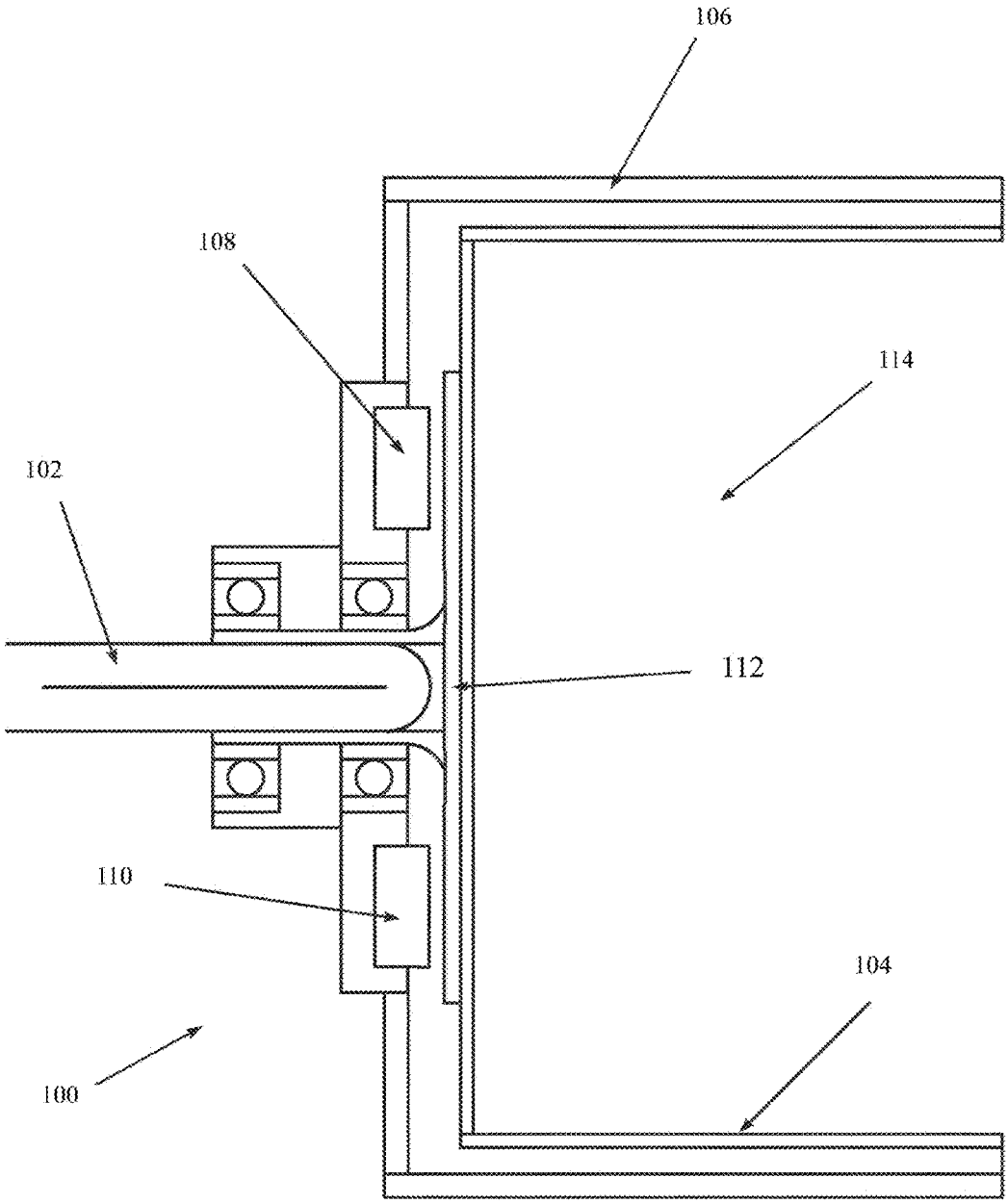
FIG. 1 shows an illustration of a heating chamber according to an exemplary embodiment of the invention.

FIG. 1 illustrates one exemplary embodiment of the invention 100, a rotating chamber 114 created by the rotation of the chamber's inner cavity 104 around a fixed (non-rotating) outer chamber 106. In one embodiment, the chamber's rotation is created by the rotation of a central shaft 102. Said shaft may be powered by a number of sources, including human, animal, wind or water via direct, belt or other means. Similarly, the rotation may be created by the use of pneumatic, hydraulic, electric (including both AC and DC models), internal combustion or other kinds of motors. In addition, in one embodiment, the motion may be created by the rotation of one chamber versus the other, as would be case if the two chambers were simply pulled via an axis along a trail.

Figure 2:
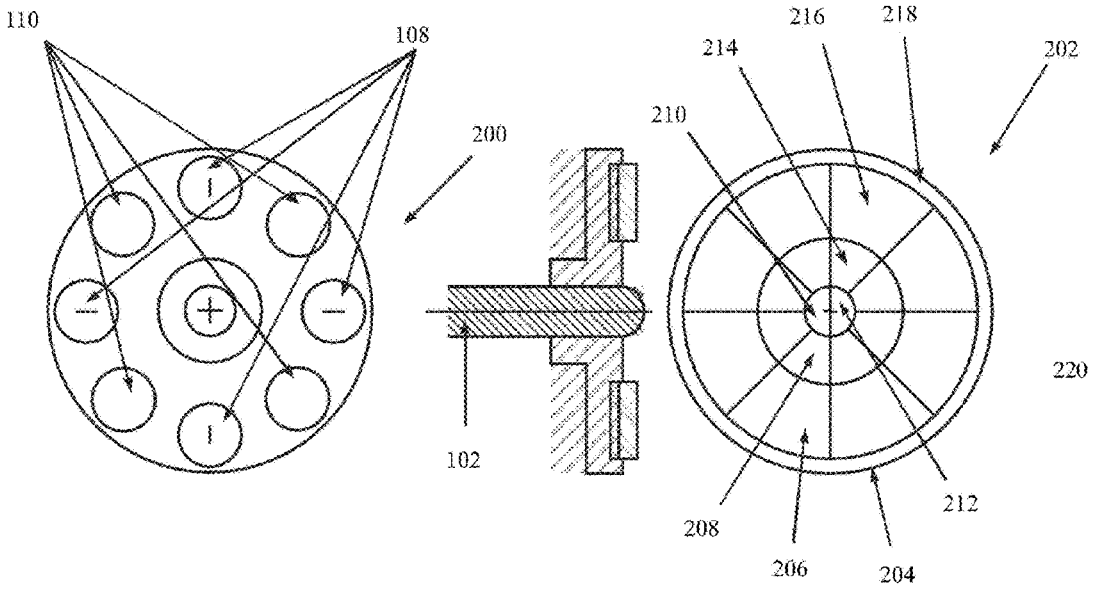
FIGS. 2 and 3 show illustrations of heating devices according to exemplary embodiments of the invention.

The rotary motion of one chamber relative to the other is required in order to induce a varying magnetic field (created by exposure to successive alternating North-South polarity magnets) on one or more heating elements, in one embodiment formed by one or more heat plates 112. This magnetic field flux causes the heat plates 112 to get warm, as a reflection of how fast it is changed. As seen in FIG. 2, there are many embodiments possible in placing the magnets on the magnet holder plate 116 (discussed below). Many previous implementations have used rotating magnet holder plates, but in one embodiment, the present invention allows them to remain fixed, and rotation of the material chamber provides the advantage of a direct-link, one (or less) motor solution.

The heating element, whether a heat plate 112 or a hoop 302, may be comprised of any combination of metal, metal coated surface or embedded metal (within the structure) including alone or in combination (or composite) of ferrous or magnetic metals (those comprised of metals with magnetic properties, including but not limited to iron, steel, etc.) as well as non-ferrous or non-magnetic metals (including but not limited to copper, aluminum, etc.). In one embodiment, the complete rotating assembly 104 is made of metal, in order to conduct the heat generated at the heat plate 112 throughout the walls of the rotating chamber 114. In an alternate embodiment, only the heat plate 112 is made of metal, with the balance of the rotating assembly made of plastic, wood or such other low cost material. In an alternate embodiment, metallic rods are embedded on a ceramic envelope (such as with a pizza stone where the heat is induced by the rotation of the magnetic surface).

To prevent the accidental burning of the material inside the heating chamber 114, in one embodiment a grill or other fluid-allowing element is placed over the portions of the heat plate 112 coming in contact with the material, and vanes are placed inside the rotating chamber 104 surfaces to facilitate the "tumbling" of the materials within the chamber 114. In one embodiment, air input/exhaust means are created by placing openings along the walls of the rotating chamber 104, and vanes in connection to input/output valves to facilitate the creating of an exhaust stream of the humid heated air. One embodiment of this would be to create a chimney effect by placing an exit opening on the top of the outer chamber 106, and an opening at the bottom (with or without valves). In an alternate embodiment, a fan powered from the rotation of the shaft 102 could be added. In one embodiment, the vanes placed within the rotating chamber 104 would also do it. In an alternate embodiment, vanes placed between the rotating 104 and fixed 106 chambers could also do it.

Figure 5:
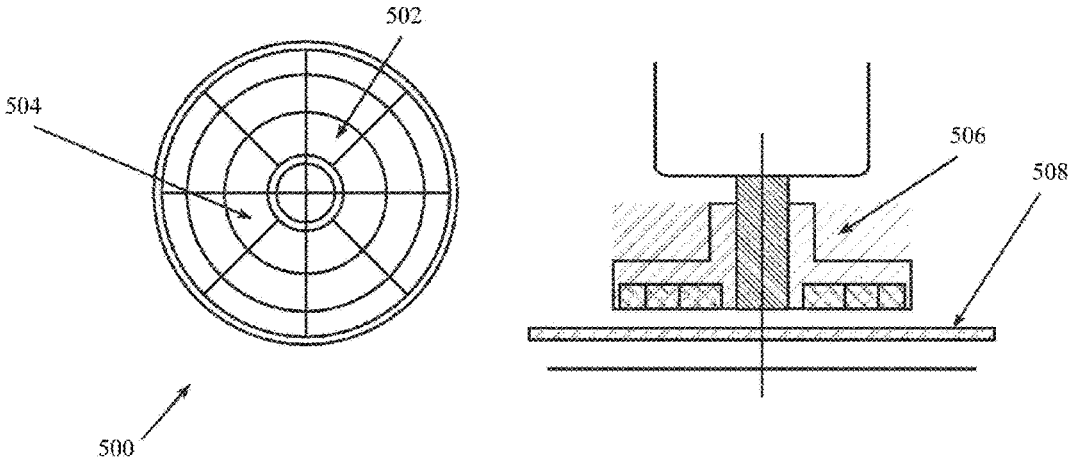
FIG. 5 shows an illustration of a heating or levitation device according to an exemplary embodiment of the invention.

In one embodiment, the magnet holder plate 116 has one or more pairs of North polarity (N-pot 108) and South polarity (S-pot 110) permanent magnets placed around a single non-rotating flat disk. These N-pol, S-pol pairs of magnets may be circular 200 in shape, triangular, or any other geometrical combination thereof. In one embodiment, pairs of permanent magnets may be used, so that one particular radial axis of the wheel contains a S-N-S polarity (or N-S-N) at the opposite end. In that case, the area of the magnets need not be similar, but would be optimal as long as the area of their opposite pole is significantly similar. (204 to 218), (206 to 216), (208 to 214) and (210 to 212). Similarly, as seen in FIG. 5, the same can be done with the segments, as long as the paired opposite magnet sections (502 to 504). In an alternate embodiment, the number of N-S magnets need not match.

Note that in defining North or South polarity on a permanent magnet, we are using the "North" pole of a magnet as defined by the National Bureau of Standards (NBS) convention. Said convention is based on the following: "The North Pole of a magnet is that pole which is attracted to the geographic North Pole. Therefore, the North Pole of a magnet will repel the north seeking pole of a magnetic compass." Its significant opposite is the South Polarity.

As the inner cavity 104 rotates, the attached heat plate 112 also rotates, and the magnetic field of each permanent magnet will induce an oscillating magnetic field over the heat plate 112 as the polarity of this induced magnetic field is sequentially reversed, inducing a temperature increase on the heat plate 112 as well as on any other metallic surface portion of the rotating inner cavity 104 subjected to the magnetic field flux.

Figure 3:
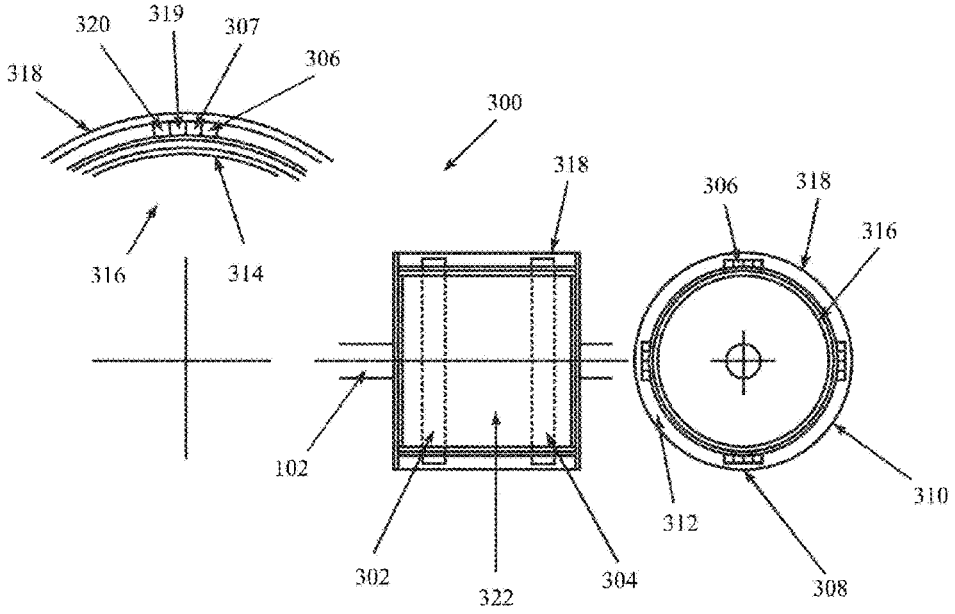

In another exemplary embodiment, illustratively shown in FIG. 3 the magnetic flux variation is induced on a heating element comprised of one or more metallic hoops (302, 304) or sections of hoops placed around the waist of a rotating cylindrical structure 316 placed within a non-rotating chassis 318. The rotating portion 316 is turned by a shaft 102. Notice said hoops need not be continuous as shown in FIG. 3, and may be constructed of dis-connected segments, as long as one or more of said segments cross the alternating magnetic fields (N-S) of the magnets. These hoops function as heat plates when they linearly move through a series of magnets of N-S orientation (306 N, 307 S, 319 N, 320 S) that are placed around the periphery, in close proximity to the hoops (302, 304).

As the hoops pass during the rotation of the inner rotating structure 316, the magnetic flux transition will cause the temperature of the hoops (302, 304) to increase, in turn raising the temperature of the internal structure 316 and the temperature of the cavity 322. Such an arrangement would make the assembly a natural furnace with which to warm any fluids going through it. Some potential fluids in use include Oil, Air, Water, Sodium and others.

Figure 4:
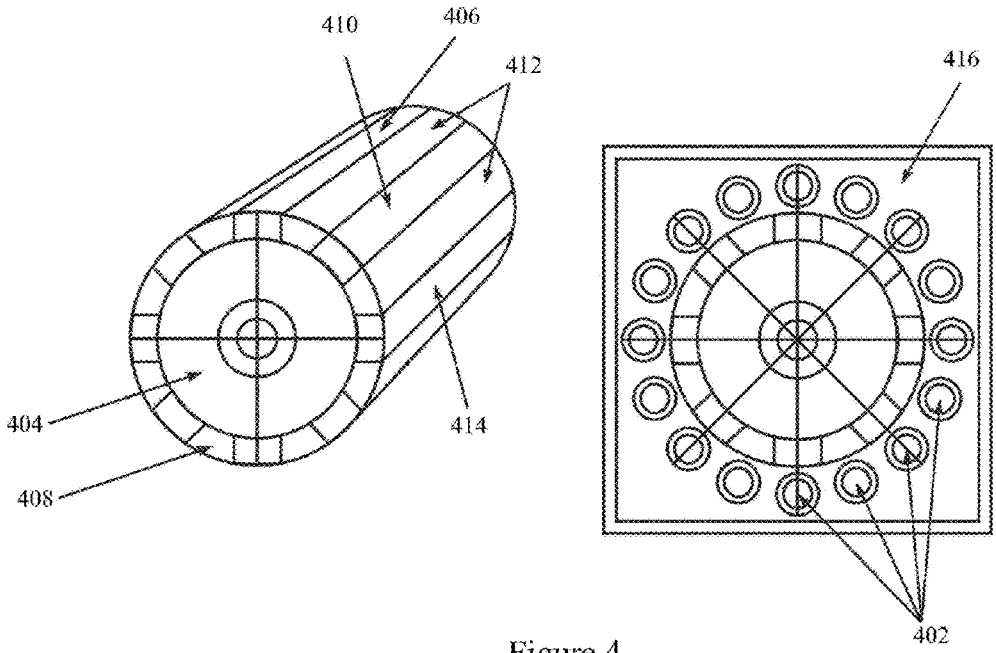
FIG. 4 shows an illustration of a fluid heating device according to an exemplary embodiment of the invention.

In another exemplary embodiment, illustrated in FIG. 4, a fluid heater 400 is illustrated. In it, tubes or pipes 402 surround a rotating permanent magnet assembly cylinder 404, whose magnetic surfaces are made of alternating N-pol (406, 414, etc.), S-Pol (408, 410, etc.) permanent magnets and optionally interposed phenolic 412 or other magnetic neutral materials. Said phenolic material may be used in other embodiments, as a way to save on magnetic material yet build appropriate structures. In order to preserve the energy generated, insulating material 416 fills the voids.

In one embodiment, the pipes are metal, or metal lined (be they ferrous or non-ferrous metals). In an alternate embodiment, the tubes are made of a non-metallic material (for example PVC), but contain either an internal metallic lining, an internal hollow tube of lesser diameter made of metal, or simply a solid metal rod. In an alternate embodiment, the metal rod within the non-metallic tube is itself encased in a plastic shell or sheathing, to minimize interaction with the fluid travelling within it. The magnetic flux hears the metallic portion, which proceeds to heat the fluid within (be it water, air or oil).

Figure 6:
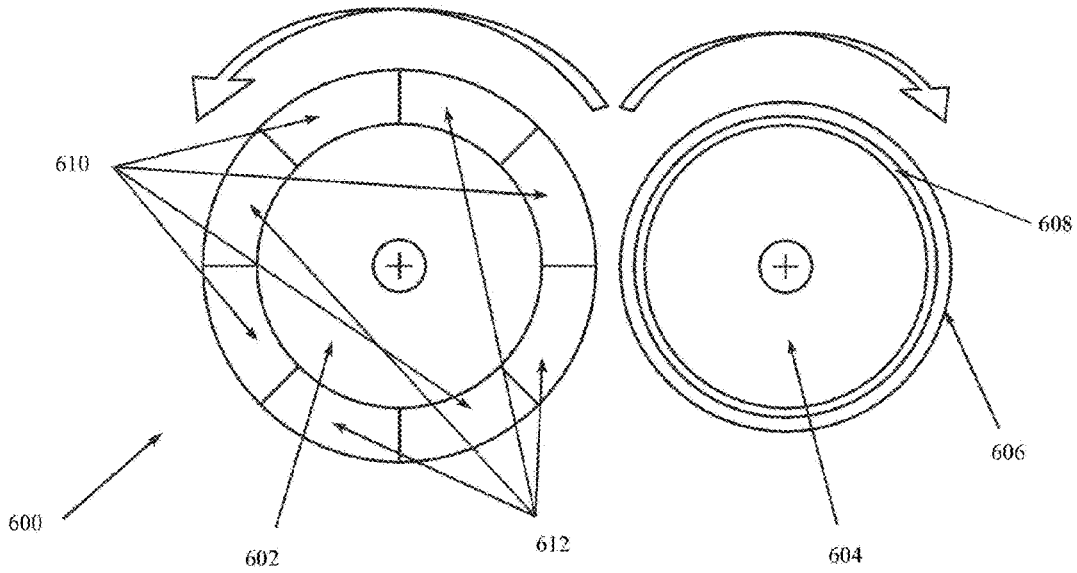
FIG. 6 shows an illustration of a fluid heating device according to an exemplary embodiment of the invention.

In another exemplary embodiment, illustrated in FIG. 6, a rotating induction heater 600 is shown. A permanent magnet first cylinder 602 containing a series of alternating permanent magnets on its periphery (N-pol 610, S-pol 612) is rotated (counterclockwise direction is shown, but either direction may be used) to accomplish the desired magnetic flux variation. In an alternate embodiment, phenolic material may be interspersed with between the N-pol, S-pol magnets.

A second cylinder 604 made of a combination ferrous 608 and non-ferrous 606 materials is located in a significant parallel arrangement to the first cylinder. In one embodiment, the inner layer of the cylinder is made of ferrous materials, and the outer layer or skin is made of non-ferrous materials. In an alternate embodiment, the order is reversed, with the non-ferrous material being on the outside. In another embodiment, outer layer is made of a non-metallic material, such as plastic or carbon fiber. In an alternate embodiment, one or more second cylinders surround the first cylinder, all receiving induced heat from the rotating magnetic flux.

In one embodiment, the second cylinder is made to rotate in the opposite direction (Clockwise (CK) if the first is going Counter-Clockwise (CCK), CCK if the first is going (CK)). In yet another embodiment, they are going in the same direction (CK to CK, CCK to CCK). Rotation of the cylinders may come from the same mechanical means (motor, gears, etc.), or from separate means. In one embodiment, one of the cylinders may be made to rotate, and the contact between the first and second cylinder used to rotate the second.

As before, the magnetic flux change induced on the second cylinder generates heat. In one embodiment, the heat is removed by a fluid (liquid or gas) flowing through the inside of the second cylinder. In an alternate embodiment, the complete assembly is submerged in the fluid, and the heat generated is communicated to the surrounding fluid.

In another exemplary embodiment, illustrated in FIG. 5, an induction heater 500 can be seen. In it, a rotating permanent magnet surface 506, similar in construction to the ones embodied above (N-pol 502, S-Pol 504, etc.), proceed to generate a varying magnetic flux on the metallic surface 508. In one embodiment the surface 508 is ferrous, in another non-ferrous. In an alternate embodiment, the surface is non-metallic, with metallic members embedded in them.

As an interesting side effect, the induction of the magnetic flux from the rotating surface on a non-ferrous surface (or a non-metallic surface with non-ferrous elements embedded in it) causes an opposite but equal force orthogonal to the rotation of the surface, in effect causing a levitation force that pushes the surfaces apart with a force proportional to the rotation of the disk.

With such a force, a minimal friction vehicle could be designed to travel over metal or metal covered rails. In an alternate embodiment, the rail is placed on the vehicle, and a collection of rotating surfaces is laid on the roadway at an appropriate distance, rotating only at the time the vehicle is above.

In one embodiment, the motor means and magnet surface are embedded within a cooking surface, and the heating plate is formed as the bottom of a cooking pot or pan. Rotation of the motor will induce heat upon the bottom of the cooking pot.

As before, in one embodiment the magnetic field is built linearly (as a succession of N-pol, S-pol permanent magnets with or without any phenolic material between them), that moves along an axis, and significantly parallel to a non-ferrous metal surface laid along a railway or roadway (or portions of a surface, or portions of a rail). As the vehicle reaches a critical speed, it the magnetic flux would generate sufficient "lift" (really opposite force) to both reduce its effective load on the load bearing wheels, or even eliminate it and travel "airborne". In an alternate embodiment, the metal/composite rail would be on the vehicle, and the magnets would be on the roadway.

The above would provide significant efficiencies to a Metro system (trains at speed would get "free" lift), as well as potentially create an assist to the Catapult launching of aircraft, as the speed of the vehicle would provide significant lift (and they are made mainly of aluminum).

Figure 7:
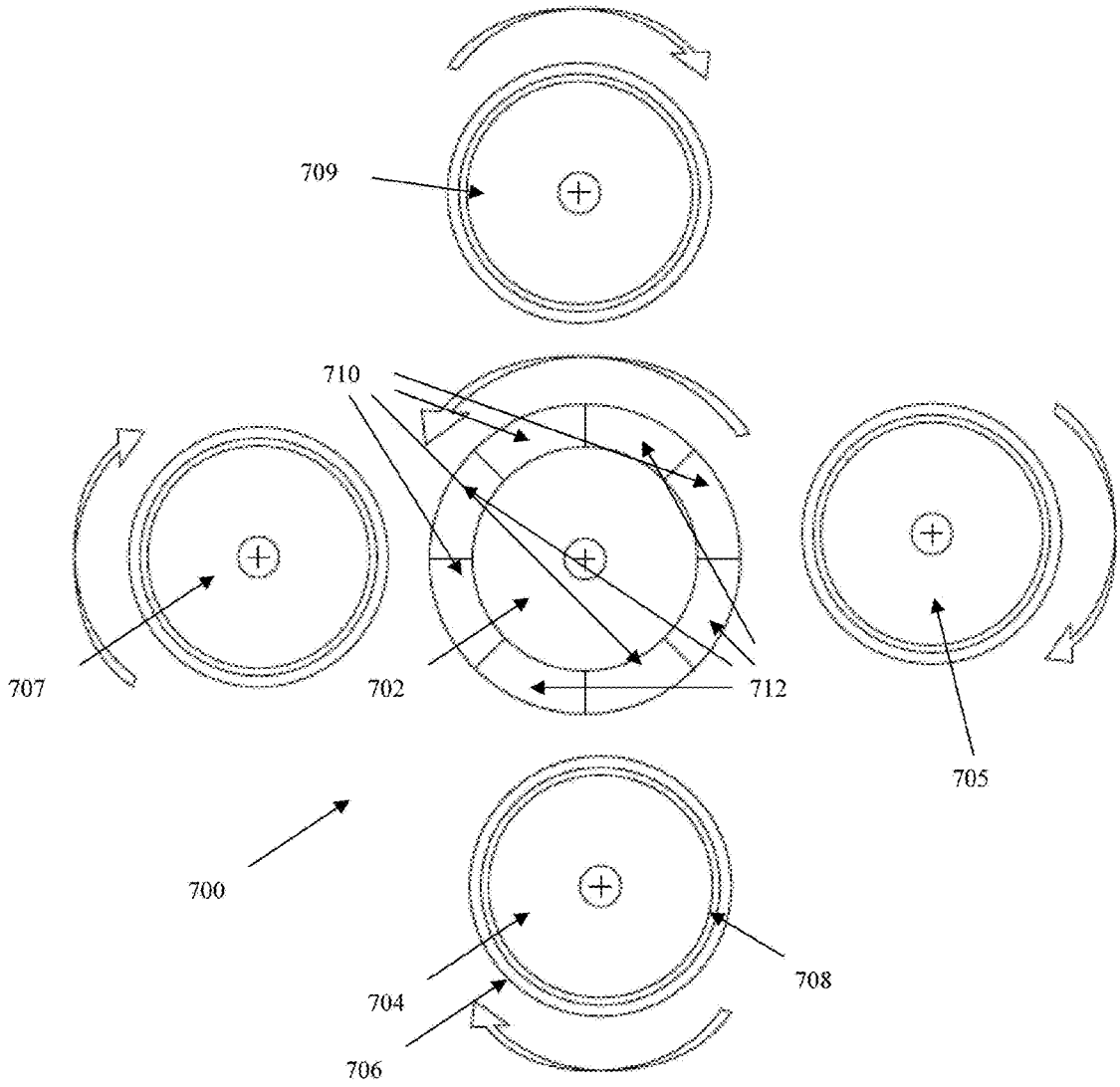
FIG. 7 shows an illustration of a fluid heating device according to an exemplary embodiment of the invention.

In an alternate embodiment, exemplary illustrated in FIG. 7 a rotating induction heater assembly 700 is shown. A permanent magnet inner cylinder 702 containing a series of alternating permanent magnets on its periphery (N-pol 710, S-pol 712) is rotated (counterclockwise direction is shown, but either direction may be used) to accomplish the desired magnetic flux variation. In an alternate embodiment, phenolic, plastic or non-ferrous material may be interspersed with between the N-pol, S-pol magnets.

One or more orbital cylinders 704, 705, 707, 709 made of a combination ferrous 708 and non-ferrous 706 materials is located in a significant parallel arrangement to the first cylinder. In one embodiment (704), the inner layer of the cylinder is made of ferrous materials 708, and the outer layer or skin is made of non-ferrous materials 706. In one embodiment, all cylinders are made like this. In an alternate embodiment, the order is reversed, with the non-ferrous material being on the outside.

In one embodiment, all the orbital cylinders are made this way. In an alternate embodiment, the orbital cylinders are paired, so that antipode cylinders are made of similar materials (704 with 709, 705 with 707), but not all pairs are identical in makeup. In this way, a system having a central or inner cylinder rotating at a constant speed, may induce different temperatures in the fluids contained within the various pairs of orbital or outer cylinders.

In one embodiment, the orbital cylinders are made to rotate in the opposite direction (Clockwise (CK) if the first is going Counter-Clockwise (CCK), CCK if the first is going (CK)). In yet another embodiment, they are going in the same direction as the inner or central cylinder (CK to CK, CCK to CCK). Rotation of the inner and orbital cylinders may come from the same mechanical means (motor, gears, etc.), or from separate means. In one embodiment, one or more of the orbital cylinders may be made to rotate, and the contact between either the central or even one or more of the orbital cylinders is used to rotate it.

As before, the magnetic flux change induced on one or more of the orbital cylinders generates heat. In one embodiment, the heat is removed by a fluid (liquid or gas) flowing through the inside of the orbital second cylinders. In an alternate embodiment, the complete assembly is submerged in the fluid, and the heat generated is communicated to the surrounding fluid.

Figure 8:
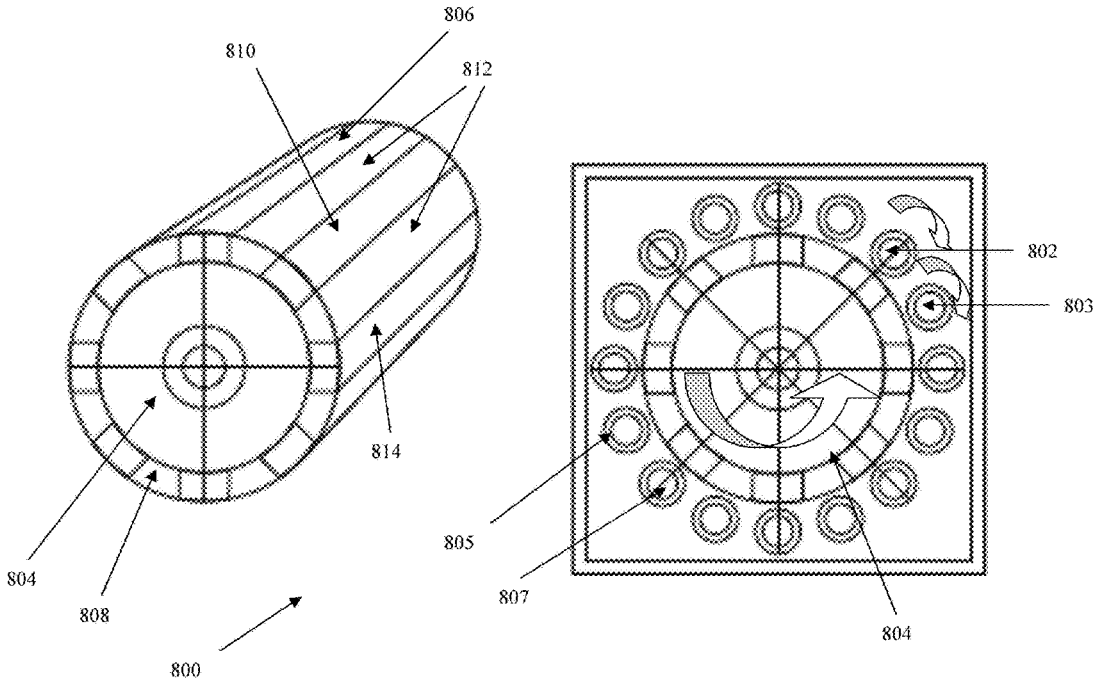
FIG. 8 shows an illustration of a fluid heating device according to an exemplary embodiment of the invention.

In a similar multi-orbiting cylinder embodiment, seen in an illustrative exemplary embodiment in FIG. 8, a fluid heater 800 is illustrated. In it, orbital tubes or pipes (802, 803, 805, 807 and others) rotate themselves and surround a rotating permanent magnet assembly cylinder 804, whose magnetic surfaces are made of alternating N-pol (806, 814, etc.), S-Pol (808, 810, etc.) permanent magnets and optionally interposed phenolic 812 or other magnetic neutral materials. Said phenolic material may be used in other embodiments, as a way to save on magnetic material yet build appropriate structures. In order to preserve the energy generated, insulating material 816 fills the voids.

In one embodiment, the orbital pipes (802, 803, 805, 807 and others) are metal, or metal lined (be they ferrous or non-ferrous metals). In one embodiment, as with the exemplary embodiment shown in FIG. 7, the outside of the orbital tube is comprised of a ferrous metal, while the inside is lined of a non-ferrous metal. In an alternate embodiment, it is the reverse, with the non-ferrous material being on the outside. The non-ferrous material may be a metal like aluminum or copper, or it may also be a phenolic material like polymers (plastics), wood, or others.

In an alternate embodiment, the orbital pipes are made of a non-metallic material (for example PVC), but contain either an internal metallic lining, an internal hollow tube of lesser diameter made of metal, or simply a solid metal rod. In an alternate embodiment, the metal rod within the non-metallic tube is itself encased in a plastic shell or sheathing, to minimize interaction with the fluid travelling within it. The magnetic flux hears the metallic portion, which proceeds to heat the fluid within (be it water, air or oil).

As in FIG. 7, the orbital pipes or tubes in FIG. 8 may be designed so that one or more of them rotate along a central orbital axis. This allows for a reduction in magnetic field losses (and hence higher system efficiency). The orbital tube rotation may be mechanically induced (through friction with the internal rotating cylinder 804), or through other mechanical means such as belts connected to other motors, or the motor generating the rotation of the central cylinder 804.

They may also be antipodally paired (cylinder 802 with its diametrically opposite 807, 803 with 805, etc.), to match the heat being induced within them, without all of them being identical. This would ensure the heat induced on the fluid within pair 802-807 is not necessarily identical to that in the pair 803-805. Similarly, the rate of rotation may be similarly accelerated or slowed down (via separate mechanical means) to generate some of the same pairing temperature difference.

In another embodiment, the fluid being passed through certain orbital tubes may not be identical. In that form, one or more orbital tubes may be dedicated to generating air heating (for a forced air system), while others are dedicated to heating water for a water heater.

Figure 9:
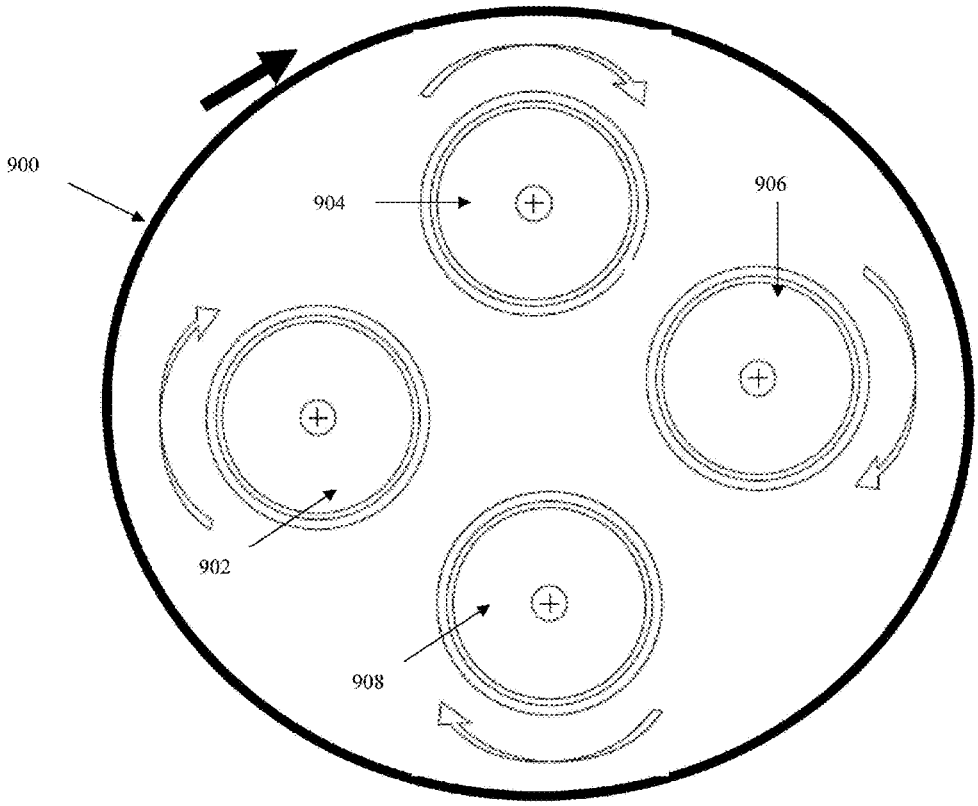
FIG. 9 shows an illustration of a fluid heating device according to an exemplary embodiment of the invention.

Note that the permanent magnet rotating unit need not be only in the inside. In the exemplary embodiment shown in FIG. 9, the element containing the permanent magnets 900 is placed as an rotating ring outside the one or more orbital elements 902, 904, 906, 908. In one embodiment, the orbital elements are stationary, while in an alternate embodiment, they are rotating. This rotation may be self-induced, or mechanically/electrically produced to match that of the outer ring.

The orbital rings may be of construction similar to that of those illustrated in FIG. 7 or FIG. 8, that is, as a sandwich of ferrous materials within non-ferrous materials, or vice-versa, with the ferrous material on the outside. As before the rotations may match, or be counter (assisted via mechanical/electrical means).

Various embodiments and features of the present invention have been described in detail with a certain degree of particularity. The utilities thereof can be appreciated by those skilled in the art. It should be emphasized that the above-described embodiments of the present invention merely describe possible examples of the implementations to set forth a clear understanding of the principles of the invention, and that numerous changes, variations, and modifications can be made to the embodiments described herein without departing from the spirit and scope of principles of the invention. Also, such variations and modifications are intended to be included herein within the scope of the present invention, as set forth in the appended claims. The scope of the present invention is defined by the appended claims, rather than the forgoing description of embodiments. Accordingly, what is desired to be secured by Letters Patent is the invention as defined and differentiated in the following claims, and all equivalents.

The invention claimed is:

1. A permanent magnet thermal generator apparatus comprising;

a magnetic cylinder rotatable about its concentric longitudinal axis whose magnetic surface is made of alternating N-pol and S-pol permanent magnets;

one or more hollow orbital pipes, each said orbital pipe freely rotatable about its own concentric axis of rotation, wherein said axis of rotation is parallel to and offset from the longitudinal axis of said magnetic cylinder, each said orbital pipe having at least one metal portion directly exposable to a magnetic field to be generated by said N-pol and S-pol magnets mounted within said magnetic cylinder when said magnetic cylinder is rotated so that any rotation of each said orbital pipe is due solely to the effect of the magnetic field induced on said orbital pipe by said magnetic cylinder rotation; and a mechanism for rotating said magnetic cylinder around its longitudinal axis, and said magnetic cylinder when so rotated induces independent rotation of each said one or more hollow pipes about its respective offset concentric longitudinal axis.

2. The apparatus of claim 1 wherein;

said orbital pipes are comprised of ferrous metals.

3. The apparatus of claim 1 wherein;

said orbital pipes are comprised of non-ferrous metals.

4. The apparatus of claim 1 wherein;

said orbital pipes are comprised of a combination of ferrous and non-ferrous metals.

5. The apparatus of claim 1 wherein;

said orbital pipes are comprised of a combination of metallic and non-metallic materials.

6. The apparatus of claim 1 wherein;

said orbital pipes are comprised of solid metal rods contained within non-metallic tubes.

7. A permanent magnet thermal generator apparatus comprising;

a hollow magnetic cylinder rotatable about its concentric longitudinal axis whose magnetic surface is made of alternating N-pol and S-pol permanent magnets;

one or more hollow orbital pipes located inside said hollow magnetic cylinder and having at least one metal portion directly exposable to a magnetic field to be generated by said N-pol and S-pol permanent magnets mounted on said hollow magnetic cylinder when said hollow magnetic cylinder is rotated, each said hollow orbital pipes is freely rotatable about its concentric axis of rotation, wherein said axis of rotation is parallel to and offset from the longitudinal axis of said magnetic cylinder, and located inside the inner surface of said hollow magnetic cylinder so that any rotation of each said orbital pipe is due solely to the effect of the magnetic field induced on said orbital pipe by said magnetic cylinder rotation; and a mechanism for rotating said magnetic cylinder around said magnetic cylinder's longitudinal axis and said magnetic cylinder when so rotated induces independent rotation of each said one or more hollow orbital pipes about its respective offset concentric longitudinal axis.

8. The apparatus of claim 7 wherein;

said elongated heating elements are comprised of hollow pipes comprised of ferrous metals.

9. The apparatus of claim 7 wherein;

said elongated heating elements are comprised of hollow pipes comprised of non-ferrous metals.

10. The apparatus of claim 7 wherein;

said elongated heating elements are comprised of hollow pipes comprised of a combination of ferrous and non-ferrous metals.

11. The apparatus of claim 7 wherein;

said elongated heating elements are comprised of hollow pipes comprised of a combination of metallic and non-metallic materials.

12. The apparatus of claim 7 wherein;

said elongated heating elements are comprised of solid metal rods contained within non-metallic tubes.

* * * * *